US005596304A

United States Patent [19]

Tatchyn

[11] Patent Number: 5,596,304

[45] Date of Patent: Jan. 21, 1997

[54] PERMANENT MAGNET EDGE-FIELD QUADRUPOLE

[75] Inventor: Roman O. Tatchyn, Mountain View, Calif.

[73] Assignee: The Board of Trustees of the Leland Stanford Junior University, Stanford, Calif.

[21] Appl. No.: 219,769

[22] Filed: Mar. 29, 1994

[51] Int. Cl.[6] ..... H01F 7/00; H01F 7/02

[52] U.S. Cl. ..... 335/306; 335/304; 335/210; 335/212

[58] Field of Search ..... 335/284–306, 335/210–212, 214; 310/90.5; 210/222, 223; 209/38–40, 212–232, 478; 315/5.34, 5.35

[56] References Cited

U.S. PATENT DOCUMENTS 4,549,155 10/1985 Halbach ..... 335/212

FOREIGN PATENT DOCUMENTS 62010 3/1990 Japan ..... 335/284

OTHER PUBLICATIONS

E. Regenstreif, "Focusing With Quadrupoles, Doublets, And Triplets", *Focusing of Charged Particles,* vol. 1, 1967, pp. 354–410.

K. Halbach, "Design of Permanent Multipole Magnets with Oriented Rare Earth Cobalt Material", *Nuclear Instruments and Methods,* 169, 1980, pp. 1–10.

*Primary Examiner*—Michael W. Phillips
*Assistant Examiner*—Raymond M. Barrera

[57] ABSTRACT

Planar permanent magnet edge-field quadrupoles for use in particle accelerating machines and in insertion devices designed to generate spontaneous or coherent radiation from moving charged particles are disclosed. The invention comprises four magnetized rectangular pieces of permanent magnet material with substantially similar dimensions arranged into two planar arrays situated to generate a field with a substantially dominant quadrupole component in regions close to the device axis.

5 Claims, 9 Drawing Sheets

PERMANENT MAGNET EDGE-FIELD QUADRUPOLE

This invention was made with government support under Grants No. DE-AC03-82-ER1300, DE-FG06-85-ER13309, and DE-AC03-76SF0015, awarded by the Department of Energy, and Grant No. AFOSR-85-0326 awarded by the Department of Defense. The government has certain rights in this invention.

SUMMARY OF THE INVENTION

The invention relates to magnetic quadrupoles for controlling the trajectories of electrically or magnetically charged particles, such as electrons, protons, and neutrons, as they travel along a substantially linear trajectory proximate to and in the general direction of the quadrupole axis. In particular, the invention includes magnetic quadrupoles for use in particle accelerators, storage rings, and insertion devices used for generating spontaneous or coherent radiation suitable for medical diagnostic, analytical, and research use.

Presently, magnetic quadrupoles are used to control the trajectories of charged particles in linear accelerators, storage rings, and other similar particle acceleration devices. Typically, such quadrupoles comprise a 4-fold rotationally symmetric structure with 4 equi-angularly-spaced salient pole surfaces equidistant from and facing the average axis of particle motion. When ideally aligned, the quadrupole symmetry axis and the average particle trajectory axis are substantially collinear. The magnetic polarity on the pole faces is distributed in an alternating North-South-North-South pattern. In the conventional orientation a charged particle deviating to the left or right from the quadrupole axis experiences a field oriented along the vertical direction, with the sense of the field changing sign as the particle crosses the axis. Similarly, as the particle deviates from the axis in the vertical direction it experiences a field oriented along the horizontal direction, with the sense of the field changing sign as the particle crosses the axis. The relative orientation of these field components is such that if the field tends to direct the particle back to its average axis for left-right deviations, it will tend to increase the size of the vertical deviations. Conversely, if vertical deviations are suppressed, the left-right deviations are amplified. Which case prevails depends on the sign of the particle's charge and the field polarity distribution on the quadrupole facets. In conventional particle accelerator or storage ring configurations, if a series of magnetic quadrupoles with alternating polarity distributions is properly arranged along the direction of particle motion, the resulting average effect on the particle motion is to suppress both left-right and vertical deviations. In this fashion magnetic quadrupoles can be used to correct, collimate, and focus charged particle beams.

In an ideal quadrupole the strength of the field is zero on axis and increases linearly with distance away from the axis. This behavior is conventionally characterized by a parameter G, expressed in units of Tesla/meter. The larger the value of G, the larger the field at a given distance from the axis.

At present, magnetic quadrupoles are predominantly designed with 4-fold rotational symmetry and hyperbolically shaped pole surface contours to make the field distribution almost ideal, that is to say, predominantly quadrupolar, even at relatively large distances away from the axis. This art, one of whose main motivations is to provide a field with easily calculated focusing properties for particles deviating significantly far away from the quadrupole axis, is well known and has been described by many authors, including E. Regenstreif, in *Focusing of Charged Particles*, ed. A. Septier, Academic Press, (New York, 1967).

Presently, magnetic quadrupoles are predominantly constructed as permeable 4-fold rotationally symmetric yokes excited by electrical current windings, which induce the proper magnetic field polarities in the poles. For conventional quadrupole aperture diameters in the centimeter-to-several-centimeter range the maximum value of G that can be attained is limited by the power dissipation in the windings. A second type of construction, described by K. Halbach in *Nuclear Instruments and Methods*, 169, 1(1980), features a 4-fold rotationally symmetric structure constructed out of permanent magnet material. The performance of this structure is not limited by power dissipation, and it can be fabricated with apertures substantially smaller than one centimeter. Although both realizations can provide high quality quadrupole fields, their basically annular geometry imposes a number of limitations. First, they completely enclose the particle beam axis, rendering access to the beam difficult. Second, due to field-loading incompatibility the permeable quadrupole cannot be installed inside the gap of an insertion device such as an undulator, while the installation of a 4-fold rotationally symmetric permanent magnet quadrupole in an undulator is limited by the rotationally invariant size of its external vertical diameter. A second disadvantage of the permanent magnet structure is that it involves the cutting or machining of complex permanent magnet segments, with the magnetization axis of the material deviating substantially from both the normal and parallel directions defined with respect to the segment surfaces. A third disadvantage of the permanent magnet structure is that is generally more difficult to tune the value of G than in a current-controlled quadrupole.

It has now been discovered that for applications in which the particle beam deviation from the axis is sufficiently small a tunable quadrupole field of sufficiently high quality can be generated with the edge fields of a 2-fold rotationally symmetric planar arrangement of permanent magnet material. The material comprises four segments all of whose cross sections are substantially rectangular and whose axis of magnetization is perpendicular to two of the opposed faces. The planar structure features a net vertical profile that can be made small, from several centimeter to fractions of a millimeter in height, avoiding the above problems and making possible the generation of fields with values of G in excess of 100 T/m–1000 T/m. These elements can consequently be installed in particle accelerating machines and insertion devices with apertures or gaps of millimeter size and smaller, making possible a number of advances in critical areas of particle accelerator technology and in applications utilizing the generation of spontaneous or coherent radiation by charged particles.

Accordingly, it is an object of the present invention to provide quadrupoles consisting of planar arrays of permanent magnet material that can provide substantially quadrupolar field distributions in close proximity to their symmetry axis.

A further object is to provide permanent magnet quadrupoles whose parameter G is tunable.

A further object is to provide permanent magnet quadrupoles that can be configured into focusing arrays.

A further object is to provide permanent magnet quadrupoles that can be configured in focusing arrays and installed into the gap of an insertion device that contains no permeable material.

A further object is to provide permanent magnet quadrupoles that can be configured in focusing arrays and installed into the gap of an insertion device whose pole faces consist of permeable material.

A further object is to provide permanent magnet quadrupoles and quadrupole arrays with minute vertical thicknesses for the development of compact or miniaturized particle accelerating machines, focusing lattices, and insertion devices.

These and other objects and advantages of the present invention will become apparent from reading the following detailed description with reference to the accompanying drawings.

DETAILED DESCRIPTION

A "permeable" material is a material that attracts and channels magnetic fields.

An "insertion device" is either a wiggler or an undulator, both of which have been described by many authors including Krinsky et al, in *Handbook on Synchrotron Badiation*, ed. E. E. Koch (Amsterdam, 1983), in any of the embodiments known to present insertion device art.

When we describe the magnetization of a planar piece of permanent magnet material, the word "direction" is used to define the orientation of the line on which the magnetic field vector lies. Thus, the terminology "vertical direction" or "horizontal direction" is employed. To define which of two possible ways the field vector is pointing for a given direction, the word "sense" is employed. For example, we would refer to a field vector that is perpendicular to a horizontal plane and pointing upward as "oriented in a vertical direction and pointing in an upward sense".

Figure 1:
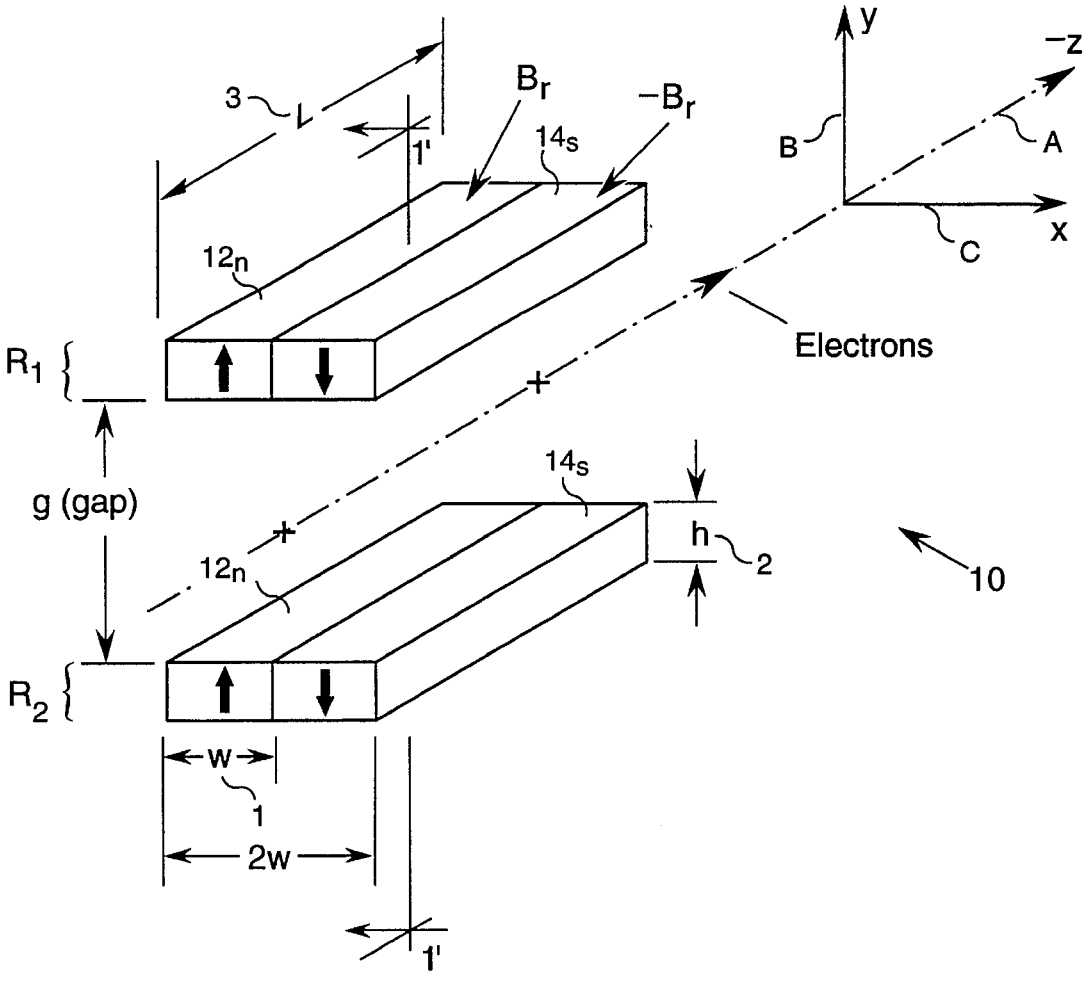
FIG. 1 is an isometric view of a planar edge-field quadrupole according to the present invention.
Figure 2:
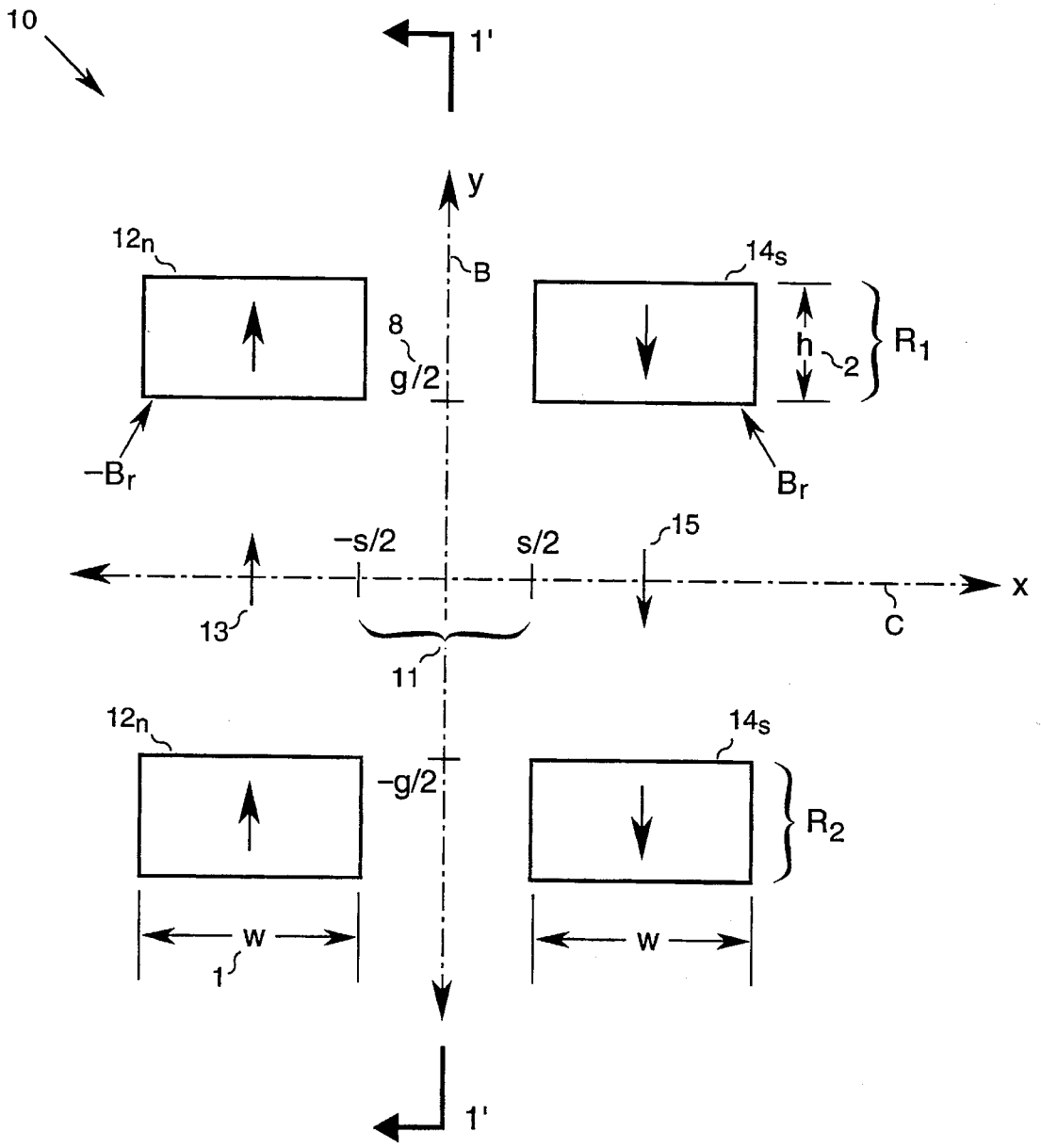
FIG. 2 is a sectional view taken along line 1'—1' of FIG. 1 with a horizontal gap s introduced between the upper and lower pairs of magnet pieces.
Figure 3:
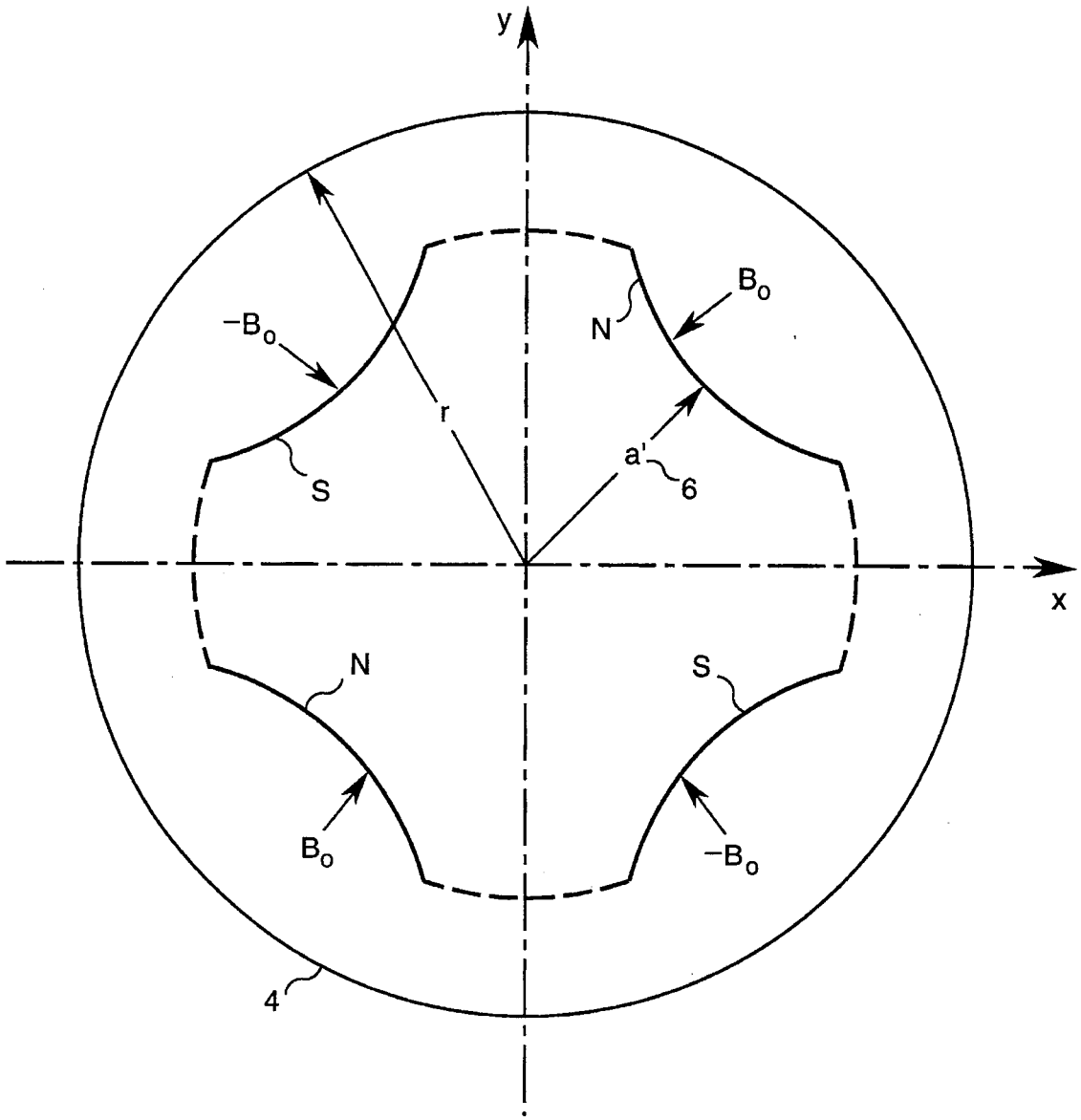
FIG. 3 is a schematic, sectional view of a conventional 4-fold rotationally symmetric quadrupole yoke composed of permeable material.

The basic construction of a planar permanent magnet edge-field quadrupole according to the present invention is shown in FIGS. 1–2. As best seen in FIG. 2, the structure of the edge-field quadrupole 10 comprises two rows $R_1$, $R_2$ of permanent magnet elements $\mathbf{12}_n$, $\mathbf{14}_s$. A horizontal gap 11 of arbitrary size s is located between elements 12 and 14. Elements 12 and 14, which have substantially similar geometrical shapes and dimensions, lie on either side of and at an equal distance from an axis B which intersects axis A in a vertical direction. As shown in FIG. 1, rows $R_1$, $R_2$ lie an equal distance above and below an axis A which, in use, is positioned substantially to coincide with the trajectory of moving electrically or magnetically charged particles. As shown schematically in FIG. 2, adjacent elements 12, 14 of each row are magnetized to provide oppositely directed magnetic fields 13, 15 on either side of axis B. In contrast to the 4-fold rotational symmetry of a conventional quadrupole shown in FIG. 3, the mechanical configuration of FIGS. 1–2 is seen to possess 2-fold rotational symmetry about the axis A. An alternative embodiment of a permanent magnet edge-field quadrupole 10 is one in which elements 12, 14 are interchanged and the directions of the resulting magnetic fields 13, 15 are reversed. In another embodiment of an edge-field quadrupole the entire structure 10 shown in FIG. 1 is rotated about the axis A by 90 degrees. In contrast to a conventional 4-fold rotationally symmetric magnetic quadrupole 4 shown in FIG. 3, for which the pole-to-pole half-gap 6 is comparable to the half-gap 8 of edge-field quadrupole 10 in FIG. 2, the 2-fold rotationally symmetric field distribution of structure 10 develops substantially stronger multipole components at comparable distances away from axis A. However, for gap 11 in FIG. 2 set to zero, and for optimized dimensions of structure 10, a substantially pure quadrupole field can still be maintained out to distances away from the axis A that are approximately g/10 in size.

The length 3 in FIG. 1 of an embodiment of a planar permanent magnet edge-field quadrupole is not restricted, but can fall into one of five regimes. First, it can be long enough so that a laterally-deviating charged particle that is deflected back toward axis A will cross it and be deflected back again to its original position to complete one full cycle of lateral motion. Second, it can be long enough so that the particle performs between three fourths and one full cycle of lateral motion. Third, it can be long enough so that the particle performs between one half and three fourths of one cycle of lateral motion. Fourth, it can be long enough so that the particle performs between almost none and one fourth of one cycle of lateral motion. Fifth, it can be long enough so that the particle performs as many such cycles and fractional parts thereof, in excess of one, as required.

Figure 4:
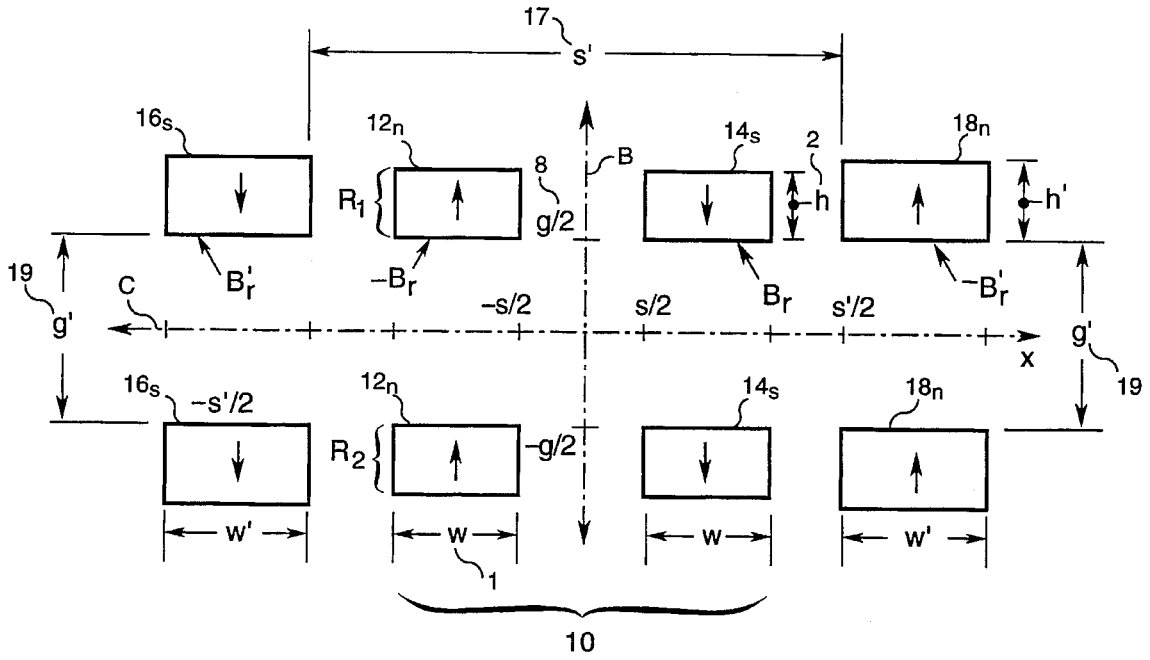
FIG. 4 comprises a sectional view of the planar permanent magnet edge-field quadrupole of FIG. 2, with a second edge-field quadrupole with a variable gap s' superimposed on it for tuning the net gradient G in the vicinity of the z axis.

The field gradient G of a planar permanent magnet edge-field quadrupole 10 can be tuned by superimposing on it the field of a second planar permanent magnet edge-field quadrupole. In the embodiment shown in FIG. 4, a permanent magnet edge-field quadrupole comprising elements 16, 18 is situated in close proximity to rows R1, R2 on which the permanent magnet edge-field quadrupole 10 is located. The magnetization of segments 16 is in the opposite sense from the magnetization of segments 12 and the magnetization of segments 18 is in the opposite sense from the magnetization of segments 14. The geometrical dimensions and the magnetization strengths of segments 16, 18 can be dissimilar from the geometrical dimensions and magnetization strengths of segments 12, 14, and the vertical gap g associated with segments 12, 14 can be dissimilar from that associated with segments 16, 18. By varying the horizontal gap 17 or the vertical gap 19, or both, a variation in the strength of G at the point of intersection of axes B and C can be effected.

Figure 5A:
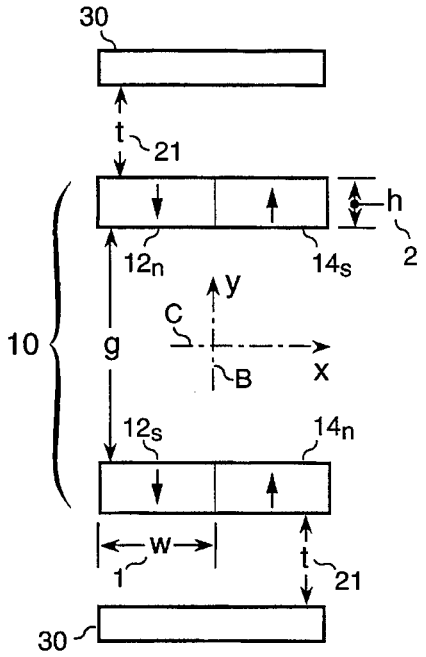
FIG. 5A is a sectional view of the planar permanent magnet edge-field quadrupole of FIG. 2, with gap s set to 0, with permeable plates positioned at a distance t above and below it for tuning the gradient G in the vicinity of the axis.
Figure 5B:
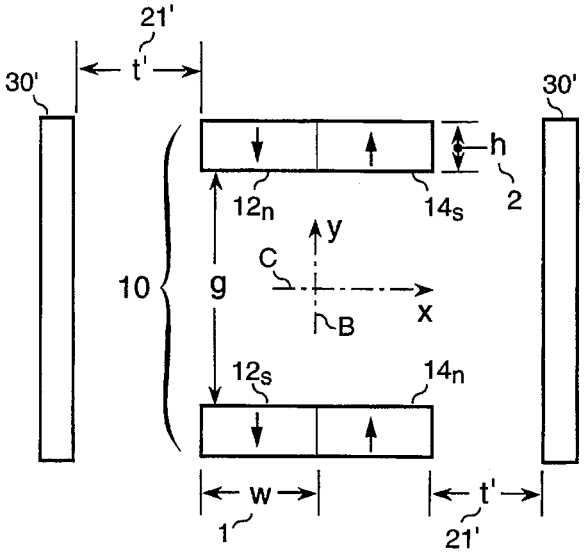
FIG. 5B is a sectional view of the planar permanent magnet edge-field quadrupole of FIG. 2, with gap s set to 0, with permeable plates positioned at a distance t' above and below it for tuning the gradient G in the vicinity of the axis.

The field gradient G of a structure 10 in FIG. 2 can also be tuned by placing sheets of permeable material in proximity to its outermost upper and lower surfaces. In the embodiment shown in FIG. 5A, each permeable sheet 30 is placed at an adjustable distance 21 from, and parallel to, the four surfaces of segments 12, 14 that are farthest removed from axis C. The fields of edge-field quadrupole 10 induce image fields in the permeable sheets 30 and the image fields then increase the value of G by an amount determined by the geometrical dimensions 1, 2, 3 of segments 12, 14, the relative permeability of sheets 30, and the value of t. In an alternative embodiment of FIG. 5B the permeable sheets are placed vertically at equal distances from axis B in an orientation parallel to the sides of segments 12 and 14 and the adjustable distance between them is varied to tune G. In this embodiment the induced image fields act to reduce the net value of G.

Figure 6:
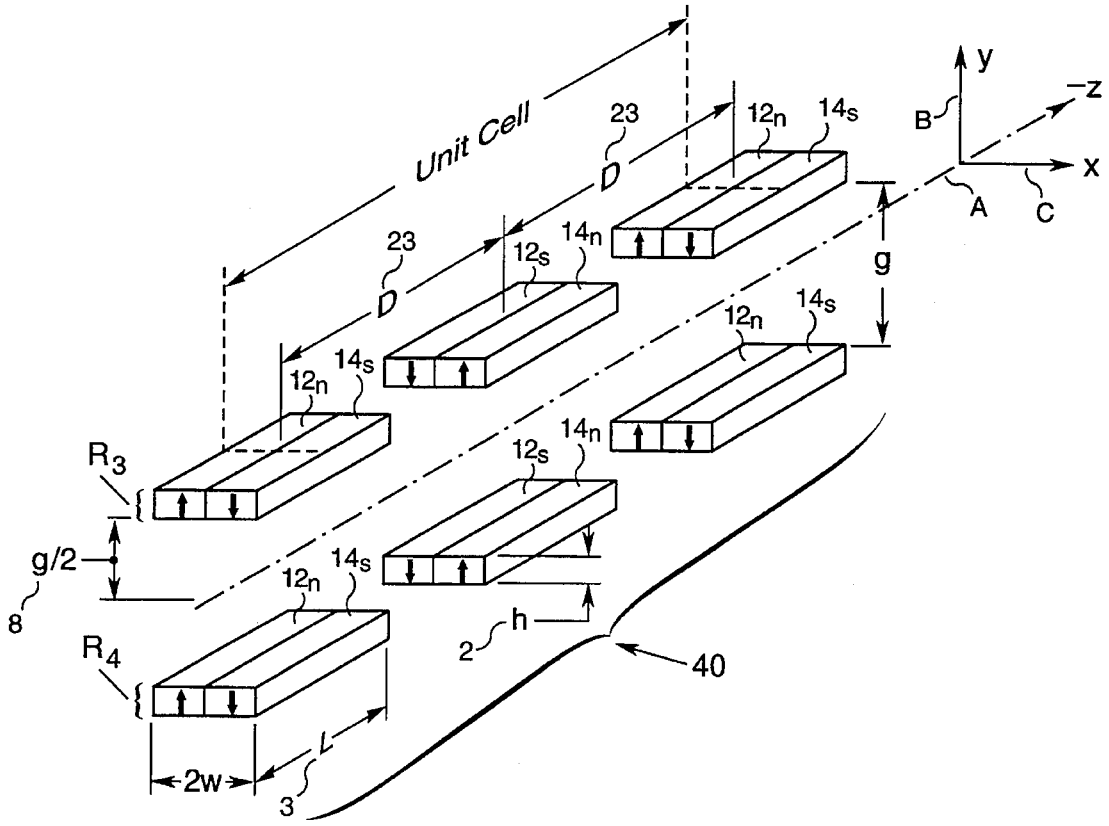
FIG. 6 is an isometric view showing a series of planar permanent magnet edge-field quadrupoles arranged in a focusing array.

The present invention also describes configurations of planar permanent magnet edge-field quadrupoles that can be used to focus, defocus, and generally modify the trajectories of charged particle beams. In FIG. 6 a focusing configuration 40 of a series of edge-field quadrupoles placed at equidistant intervals 21 along axis A is shown. Although only three edge-field quadrupoles are explicitly drawn, the actual number of quadrupoles in an embodiment of configuration 40 is defined by the design requirements associated with the trajectory modification to be performed and can be arbitrary. All the upper segments 12, 14 of the quadrupoles lie in row $R_3$ and all the lower segments 12, 14 lie in row $R_4$, with rows $R_3$ and $R_4$ located at equal distances 21' 8 with respect to axis A. In an embodiment of configuration 40 the magnetization of segments 12 and 14 is reversed in sequence for each pair of adjacent quadrupoles. In an alternative embodiment of configuration 40 the entire array of quadrupoles is rotated by 90 degrees about axis A. In another embodiment of configuration 40 every alternate quadrupole is rotated by 90 degrees about axis A and the sense of the magnetization in segments 12, 14 of the rotated quadrupoles is reversed.

Figure 7:
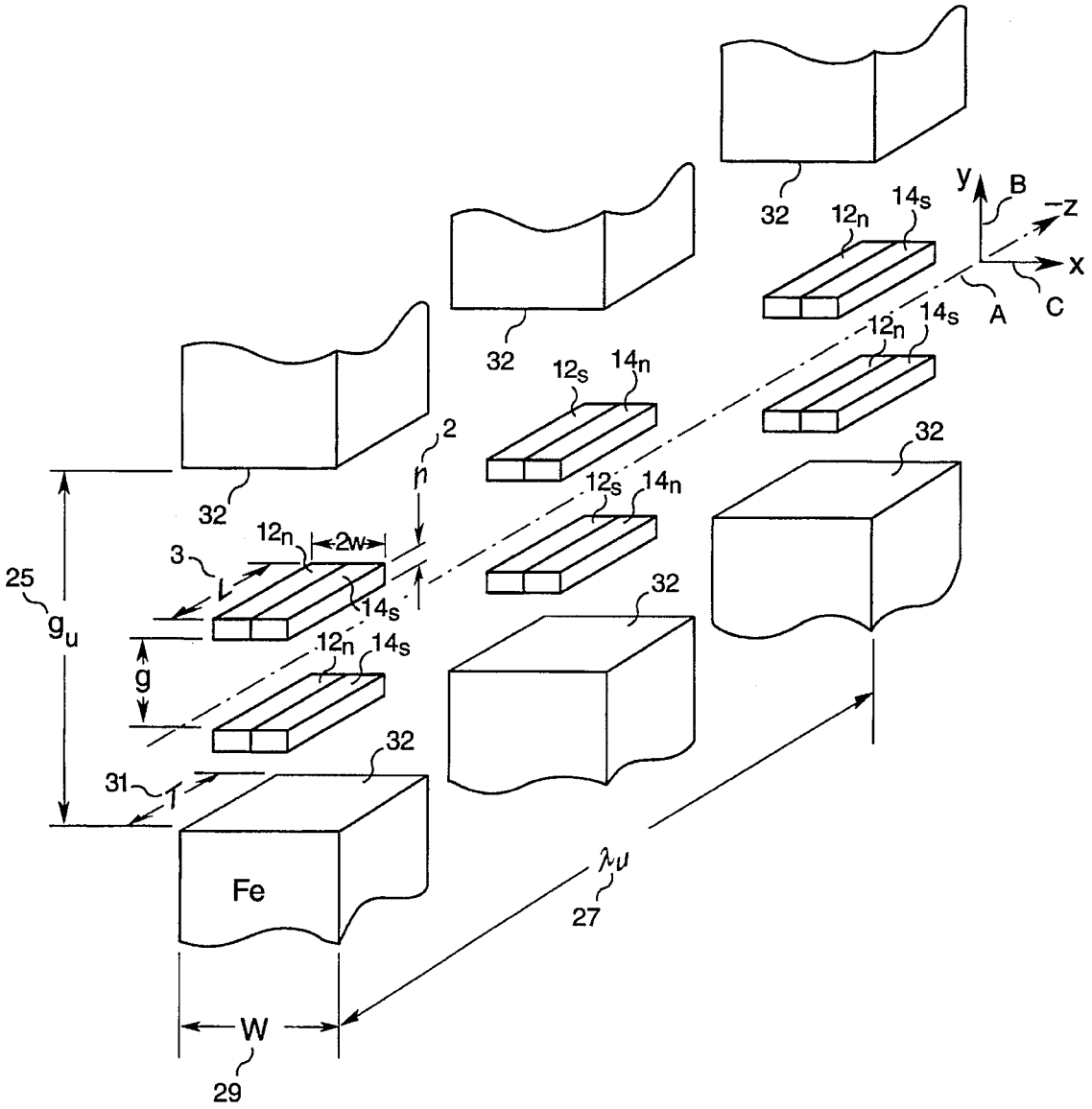
FIG. 7 is an isometric view showing a series of planar permanent magnet edge-field quadrupoles arranged in a focusing array and inserted into the gap of an insertion device with permeable poles.

Due to the feasibility of fabricating embodiments of the present invention with minute net vertical thicknesses, it becomes possible to install either single planar permanent magnet edge-field quadrupoles 10 or embodiments of focusing configurations such as 40 in FIG. 6 into the gaps of insertion devices. In the case of installation of a single edge-field quadrupole into a transverse undulator or wiggler, the magnetization sense of the magnetic pieces can be chosen so that the defocusing plane of the quadrupole coincides with the natural focusing plane of the insertion device. This can be used to null the natural vertical focusing by the insertion device as it is tuned. In an embodiment utilizing multiple edge-field quadrupoles shown in FIG. 7, configuration 40 of FIG. 6 is placed into the gap of an insertion device with permeable pole faces. In practice, the longitudinal spacing 23 between adjacent quadrupoles is to be restricted to an integral multiple of the insertion device period 27, or to one half of the insertion device period and the edge-field quadrupoles are to be centered either directly over the insertion device pole faces or exactly halfway between them in the longitudinal direction. Under these constraints the perturbation of the insertion device field by the fields of the quadrupoles will have a periodicity commensurate with the periodicity of the insertion device field, which will help minimize the effects of the focusing lattice 40 on insertion device performance. Depending on the degree to which the insertion device pole pieces 32 approach saturation under the action of the insertion device field, the edge-field quadrupole fields can also perturb the horizontal field distribution about axis A in an asymmetric fashion. Should this condition prevail, the proposed placement of the edge-field quadrupoles will also help to average out the effects of the asymmetries on charged particle motion along axis A. Likewise, due to the proposed placement of the focusing lattice 40, the lateral dimensions 29, 31 of the insertion device pole faces can be made arbitrary with respect to the corresponding lateral dimensions of segments 12, 14, and the pole face geometry doesn't need to be restricted to a planar shape in any particular embodiment.

Figure 8:
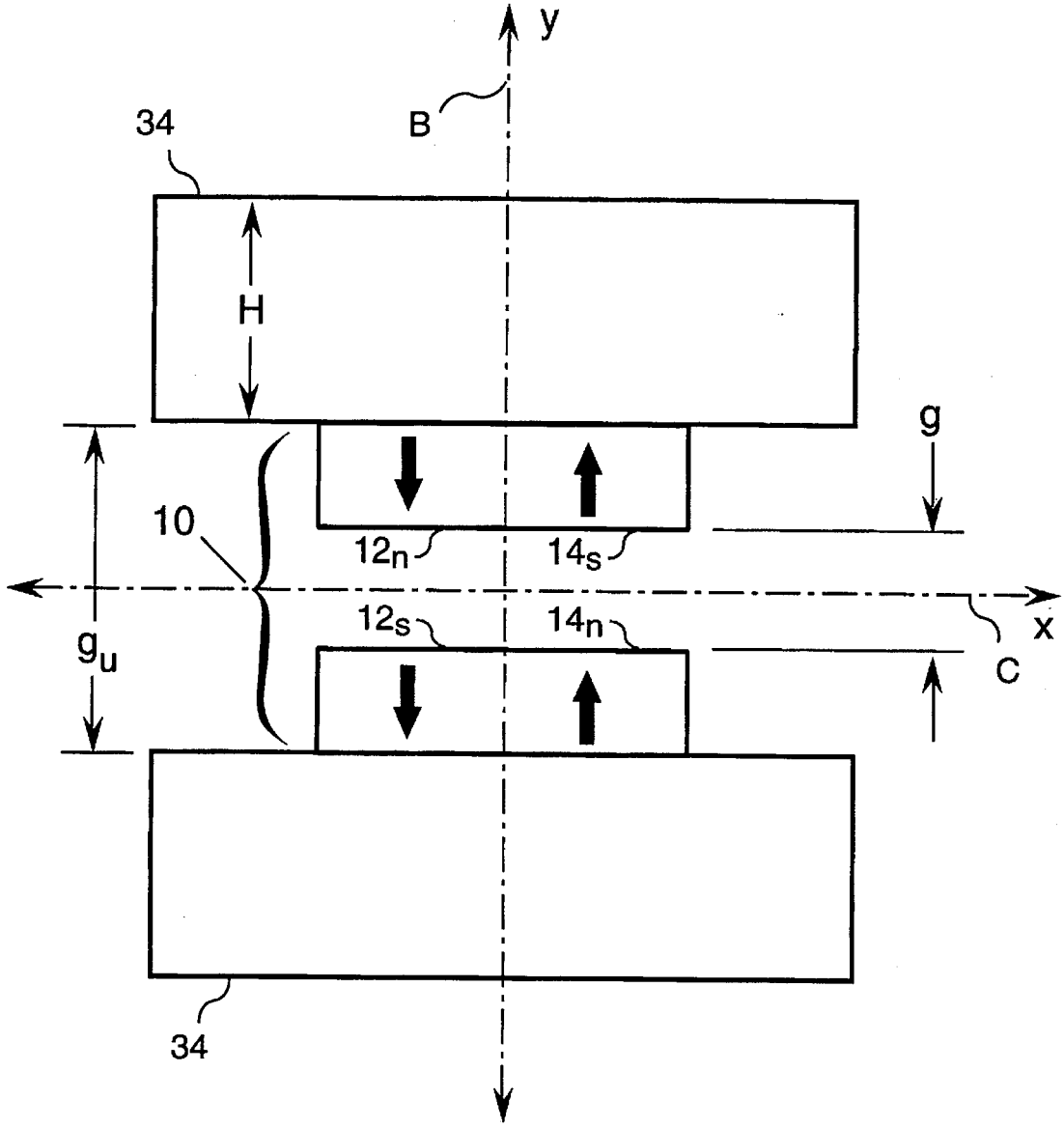
FIG. 8 is a sectional view showing the planar permanent magnet edge-field quadrupole of FIG. 2 installed in the gap of an insertion device containing no permeable material.

In FIG. 8 a sectional view of an embodiment of an edge-field quadrupole focusing lattice, such as the configuration 40 in FIG. 6, installed into the gap of an insertion device containing no permeable material, is shown. Since both the insertion device pole pieces 34 and the edge-field quadrupole segments 12, 14 are composed of permanent magnet material, the fields of both devices superpose linearly, eliminating the generation of field gradient asymmetries in the horizontal direction.

Figure 9:
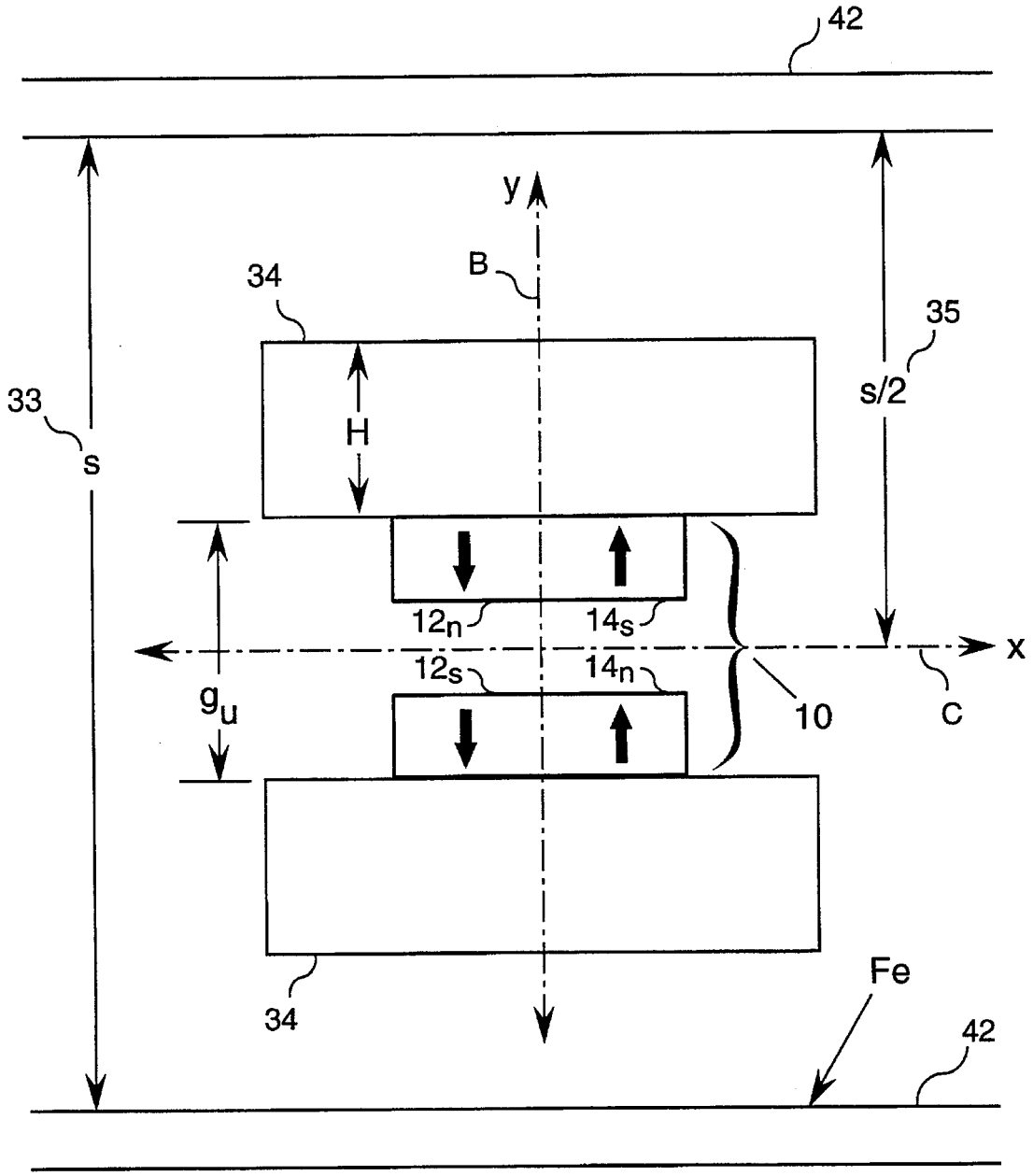
FIG. 9 is a sectional view of the planar permanent magnet edge-field quadrupole of FIG. 8 installed in the gap of an insertion device constructed out of pure permanent magnet material with the method of FIG. 5 used to tune the fields of both the edge-field quadrupole and the insertion device.

In the embodiment of FIG. 9 the embodiment of FIG. 8 is placed between two sheets 42 of permeable material, with each sheet placed at an equal distance 35 with respect to axis C. Variation of the gap size 33 between the sheets tunes the field gradient G of the edge-field quadrupole just as described for the embodiment of FIG. 5. However, due to linear superposition the field amplitude of the insertion device along axis A is also tuned. The embodiment of FIG. 9 thus provides a means for the simultaneous tuning of the primary insertion device field along with the focusing field of the edge-field quadrupole lattice. In an alternative embodiment of FIG. 9 the two permeable sheets are placed vertically at equal distances from axis B in an orientation parallel to the sides of segments 12 and 14 and the total distance 33 between them is varied to tune G and the undulator field. In this embodiment the induced image fields act to reduce the net value of G and the insertion device field.

Having illustrated and described the principles of our invention with reference to preferred embodiments, it should be apparent to those persons skilled in the art that such invention may be modified in arrangements and detail without departing from such principles. For example, only a single edge-field quadrupole could be installed into the gap of an insertion device which would in general result in decreased focusing in the vertical vs. horizontal planes, but the insertion of more than one quadrupole into an insertion device has been explicitly shown in FIG. 6 and FIG. 7 due to the resulting capability of focusing in both the horizontal and vertical planes. As another example, we have described the arrangement of the four magnet pieces in an edge-field quadrupole as being arranged into two planar arrays, but the possibility of deviations from planarity that would not significantly diminish the quality of the quadrupolar field distribution is also assumed to be included in our embodiments. Accordingly,

I claim as our invention all such modifications as come within the true spirit and scope of the following claims:

1. A planar permanent magnet edge-field quadrupole for modifying the trajectory of an electrically or magnetically charged particle traveling along in a substantially linear trajectory that is in close proximity to the quadrupole symmetry axis, the planar permanent magnet edge-field quadrupole comprising:

four substantially rectangular magnetized pieces of permanent magnet material with substantially similar geometrical and dimensional parameters, each piece magnetized to a substantially similar level of magnetic field strength in a direction perpendicular to two of its opposed surfaces and substantially perpendicular to the axis of particle motion; and the four pieces configured into two planar arrays of two pieces each, with the arrays located at an equal distance above and below the axis of particle motion, with one planar array parallel to and directly above the other; and the two adjacent pieces in each planar array magnetized in a direction perpendicular to the plane of the array, with the sense of magnetization of the piece on the left opposite to the sense of magnetization of the other piece; and the sense of magnetization of each piece in the top array being the same as the sense of magnetization of the piece directly below it; and the two adjacent pieces in each planar array separated by a horizontal gap of the same size, the size of the gaps being adjustable from arbitrary positive values down to zero; and in combination, each piece on the left hand side of the planar permanent magnet quadrupole provided with a means for adjusting the horizontal gap relative to the right hand piece in the same planar array: and the dimensions, positions, and magnetizations of the pieces producing a field distribution that is substantially quadrupolar out to a distance away from the symmetry axis that is intermediate between zero and approximately one half of the full vertical gap size.

2. A planar permanent magnet edge-field quadrupole for modifying the trajectory of an electrically or magnetically charged particle traveling along in a substantially linear trajectory that is in close proximity to the quadrupole symmetry axis, the hybrid planar permanent magnet edge-field quadrupole comprising:

four substantially rectangular magnetized pieces of permanent magnet material with substantially similar geometrical and dimensional parameters, each piece magnetized to a substantially similar level of magnetic field strength in a direction perpendicular to two of its opposed surfaces and substantially perpendicular to the axis of particle motion; and the four pieces configured into two planar arrays of two pieces each, with the arrays located at an equal distance above and below the axis of particle motion, with one planar array parallel to and directly above the other; and the two adjacent pieces in each planar array magnetized in a direction perpendicular to the plane of the array, with the sense of magnetization of the piece on the left opposite to the sense of magnetization of the other piece; and the sense of magnetization of each piece in the top array being the same as the sense of magnetization of the piece directly below it; and the two adjacent pieces in each planar array separated by a horizontal gap of the same size, the size of the gaps being adjustable from arbitrary positive values down to zero; and in combination, each piece on the left hand side of the planar permanent magnet quadrupole provided with a means for adjusting the horizontal gap relative to the right hand piece in the same planar array; and with two sheets of permeable material placed at equal distances below and above the bottom and top arrays of permanent magnet pieces; and with the two sheets of permeable material being substantially parallel to the planar arrays of permanent magnet pieces; and the gap between the sheets of permeable material being variable to increase the strength of the field gradient G along the symmetry axis; and the gap between the sheets of permeable material being variable to adjust the strength of the multipole field components along the symmetry axis,; and in combination, the upper sheet provided with a means for adjusting the gap between it and the bottom sheet independently of the gap between the lower and upper arrays of permanent magnet pieces, and the dimensions, positions, and magnetizations of the permeable sheets and permanent magnet pieces producing a field distribution that is substantially quadrupolar out to a distance away from the symmetry axis that is intermediate between zero and approximately one half of the full vertical gap between the permanent magnet pieces.

3. The planar permanent magnet quadrupole of claim 2 wherein said pair of sheets of permeable material comprise opposed undulator pole surfaces.

4. The planar permanent magnet quadrupole of claim 2 wherein said pair of sheets of permeable material comprise opposed dipole pole surfaces.

5. A planar permanent magnet edge-field quadrupole for modifying the trajectory of an electrically or magnetically charged particle traveling along in a substantially linear trajectory that is in close proximity to the quadrupole symmetry axis, the planar permanent magnet edge-field quadrupole comprising:

four substantially rectangular pieces of magnetized permanent magnet material with substantially similar geometrical and dimensional parameters, each piece magnetized to a substantially similar level of magnetic field strength in a direction perpendicular to two of its opposed surfaces and substantially perpendicular to the axis of particle motion; and the four pieces configured into two planar arrays of two pieces each, with the arrays located at an equal distance above and below the axis of particle motion, with one planar array parallel to and directly above the other; and the two adjacent pieces in each planar array magnetized in a direction perpendicular to the plane of the array, with the sense of magnetization of the piece on the left opposite to the sense of magnetization of the other piece; and the sense of magnetization of each piece in the top array being the same as the sense of magnetization of the piece directly below it; and the two adjacent pieces in each planar array separated by a horizontal gap of the same size, the size of the gaps being adjustable from arbitrary positive values down to zero; and with two sheets of permeable material placed at equal distances to the right and to the left of the bottom and top arrays of permanent magnet pieces; and with the two sheets of permeable material being substantially vertically oriented and centered midway between the two planar arrays of permanent magnet pieces; and the horizontal gap between the sheets of permeable material being variable to vary the strength of the field gradient G along the symmetry axis; and the horizontal gap between the sheets of permeable material being variable to adjust the strength of the multipole field components along the symmetry axis; and in combination, the left sheet provided with a means for adjusting the horizontal gap between it and the right sheet independently of the vertical gap between the lower and upper arrays of permanent magnet pieces, and the dimensions, positions, and magnetizations of the permeable sheets and permanent magnet pieces producing a field distribution that is substantially quadrupolar out to a distance away from the symmetry axis that is intermediate between zero and approximately one half of the full vertical gap between the permanent magnet pieces.

* * * * *